US007591113B2

(12) United States Patent
Mourier

(10) Patent No.: US 7,591,113 B2
(45) Date of Patent: Sep. 22, 2009

(54) PLASTERBOARD

(75) Inventor: Alexandre Mourier, Villeparisis (FR)

(73) Assignee: Placoplatre, Suressnes (FR)

( * ) Notice: Subject to any disclaimer, the term of this patent is extended or adjusted under 35 U.S.C. 154(b) by 721 days.

(21) Appl. No.: 10/499,835

(22) PCT Filed: Dec. 20, 2002

(86) PCT No.: PCT/EP02/14907

§ 371 (c)(1),
(2), (4) Date: Nov. 29, 2004

(87) PCT Pub. No.: WO03/054320

PCT Pub. Date: Jul. 3, 2003

(65) Prior Publication Data

US 2005/0076610 A1 Apr. 14, 2005

(30) Foreign Application Priority Data

Dec. 21, 2001 (GB) ..... 0130697.6

(51) Int. Cl.
*E04B 2/00* (2006.01)

(52) U.S. Cl. ..... 52/417; 52/742.13

(58) Field of Classification Search ..... 52/742.1, 52/742.13, 745.09, 417
See application file for complete search history.

(56) References Cited

U.S. PATENT DOCUMENTS

| | | | |
|---|---|---|---|
| 3,507,684 | A | 4/1970 | Wallen |
| 3,694,298 | A | 9/1972 | Veschuroff et al. |
| 3,984,596 | A | 10/1976 | Failmezger |
| 4,205,041 | A | 5/1980 | Hymes |
| 4,267,092 | A | 5/1981 | Glaser et al. |
| 4,579,610 | A | 4/1986 | Kole et al. |
| 4,657,594 | A | 4/1987 | Struss |
| 4,686,253 | A | 8/1987 | Struss et al. |
| 4,824,879 | A | 4/1989 | Montgomery et al. |
| 4,845,152 | A | 7/1989 | Palmer |

(Continued)

FOREIGN PATENT DOCUMENTS

| | | | |
|---|---|---|---|
| AU | 199660136 | B2 | 2/1997 |

(Continued)

OTHER PUBLICATIONS

Method for Determination of Water Absorptiveness of Paper and Board (Cobb method), BSI British Standards; BS 2644:1991, ISO 535:1991 (Equivalent to French Standard NF-Q-03-014) 1991.

(Continued)

*Primary Examiner*—Brian E Glessner
*Assistant Examiner*—Adriana Figueroa
(74) *Attorney, Agent, or Firm*—Cook Alex Ltd.

(57) ABSTRACT

Plasterboard is surfaced with a lining paper which is printed over the whole of one face of the board using an ink containing binder and particulate solid material, applied with a density of print such that under optically examination at least 80% of the surface of the lining paper is covered by the applied print. The particulate material has a d50 denotes a number length mean particle size such that 50% of particles have volume smaller than a sphere of diameter d50. The colour of the printed lining paper can be matched to the colour of a jointing compound used as a filler between the edges of adjacent boards. The material of d50 mean particle size in the range from 1 to 10 micrometers gives the lining paper a surface texture resembling that of jointing compounds and so reduces or removes contrasts, notably in absorbency, reflectance and gloss, between the surface of the boards and the surface of the jointing compound between boards.

13 Claims, 1 Drawing Sheet

U.S. PATENT DOCUMENTS

| | | | | | |
|---|---|---|---|---|---|
| 5,102,462 | A | | 4/1992 | Podlas | |
| 5,258,069 | A | | 11/1993 | Knechtel et al. | |
| 5,334,243 | A | | 8/1994 | Hyman | |
| 5,336,318 | A | | 8/1994 | Attard et al. | |
| 5,445,671 | A | * | 8/1995 | Herget et al. | 523/171 |
| 5,653,793 | A | * | 8/1997 | Ott et al. | 106/437 |
| 5,672,200 | A | * | 9/1997 | Heinz et al. | 106/403 |
| 6,105,325 | A | * | 8/2000 | Zuber et al. | 52/416 |
| 6,805,740 | B2 | * | 10/2004 | Canac et al. | 106/690 |

FOREIGN PATENT DOCUMENTS

| | | | | |
|---|---|---|---|---|
| EP | 0 496 682 | A1 | | 7/1992 |
| EP | 496682 | A | | 7/1992 |
| EP | 0 521 804 | A1 | | 1/1993 |
| EP | 1 076 137 | A2 | | 2/2001 |
| EP | 1076137 | A2 | * | 2/2001 |
| GB | 1 265 804 | | | 5/1968 |
| GB | 2 048 235 | A | | 12/1980 |
| WO | WO 97/02395 | | | 1/1997 |
| WO | WO 97/02395 | | * | 7/1997 |
| WO | WO 99/57371 | | * | 5/1999 |
| WO | WO 99/57371 | | | 11/1999 |
| WO | WO 01/59215 | A1 | * | 2/2001 |
| WO | WO 01/71093 | A1 | * | 3/2001 |

OTHER PUBLICATIONS

Paper, Board and pulps—Standard atmosphere for conditioning and testing and procedure for monitoring the atmosphere and conditioning of samples; BSI; BS EN 20187:1993; ISO 187:1990 (Equivalent to French Standard NF-EN-20187 Dec. 1993), 1990.
Summary of French Standard No. NFQ 03-014 Sep. 1985.
Partial English translation of French Standard NFP 74-201-0 dated Oct. 1994.
Comments on brochure entitled "A Marquer D'une Pierre Blanche!" (1995).
Partial translation of Lafarge Press Release dated Jul. 1995.
Manufactures leaflet for Duraclay and Panther A4 Bentonite (circa—Oct. 2001).
Translation of excerpts from "Peintures & Vernis" by Grandou and Pastour (1994).
English translation of manufacturer's leaflet for Beatite 30 dated Apr. 1, 2003.
English translation of Lafarge brochure entitled "System Pregydeco" (Sep. 1997).
English translation of Lafarge brochure entitled "Pregydeco" (1996).
NF Q 03-014, Norme Francaise, "Methode de determination d'absorption d'eau", Sep. 1986.
T 432 cm-99, "Water absorbency of bibulous papers", 1999.
British Standard, "Dry lining and partitioning using gypsum plasterboard", BS 8212:1995.
T 402 om-93, "Standard conditioning and testing atmospheres for paper, board, pulp handsheets, and related products", 1993.
PrEN 520, Gypsum Plasterboards, Mar. 1995.
Projet, prEN 520, "Norme Europeenne Europaische Norm European Standard", Oct. 2000.
NF EN 20187, Norme Europeenne, Atmosphere normale de conditionment et d'essai et methode de surveillance de l'atmosphere et de conditoinnement des echantillons, Dec. 1993.
NF P 72-302, "Plaques De Parement En Platre", Oct. 1981, and an English Translation.
British Standard, "Gypsum plasterboard—Part 1: Specification for plasterboard excluding materials submitted to secondary operations", BS 1230-1:1985.
NF P 74-201-1, Norme Francaise, "Travaux de peinture des batiments, Partie 1: Cahier des clauses techniques", Oct. 1994.
J R Gorman et el, "Plaster and Drywall Systems Manual", 3rd edition 1988.
The White Book, "Technical Manual of Building Products", published by British Gypsum Ltd, 1986, pp. 1, 172, 173 and 185 to 191.
The White Book, "Technical Manual of Building Products", published by British Gypsum Ltd, 1991, section bg 1.1; section f13 pp. 1 to 8; section x pp. 12.1 and a12.2, also copyright notice.
P. Grandon and P. Pastour, "Peintures & Vernis", (1994), pp. 741, 745, 746, 853, 854.
Dr. A Rawle, "Basic Principles of Particle Size Analysis", downloaded from the website of Malvern Instruments Ltd., post 1992.
Peter Blum , "PP Handbook: Chapter 7 Reflectance, Spectrophotometry and Calorimetry", 1997, downloaded from www-odp.tamu.edu/publications/tnotes/tn26/CHAP7.PDF.
Bosco S. Tjan, "Technical Note: Colour Spaces for Human Observer", Minnesota Laboratory for Low Vision Research, University of Minnesota Jun. 1996.
K.A. Phillips, "Industrial Minerals in Arizona's Wallboard Joint Cement Industry", Arizona Department of Mines and Mineral Resources, Jul. 1989.
K.A. Phillips, "Industrial Minerals in Southern California's Wallboard Joint Cement Industry", Arizona Department of Mines and Mineral Resources, Sep. 1989.
Rennes and Eklund, "The influence of binders on the structure and water sorption of coated paper", Paper and Timber Jun. 1989, pp. 698-703.
Data sheet for Georgia White #9 (1993).
Document entitled "A Marquer D'Une Pierre Blanche . . . " (1995).
Lafarges Platres Press Release dated Jul. 1995.
Manufacturer's leaflet for: Mowlith 292, Feb. 1999.
Manufacturer's leaflet for: Bermocoll (2001).
Manufacturer's leaflet for: Bentonites Duraclay Pathera A4 (2001).
Manufacturer's leaflet for: Beatite 30 (2001).
Manufacturer's leaflet for: Omya Minfil L300 (Jul. 2001).
Manufacturer's leaflet for: Omya Oxycarb 10ML (Jul. 2001).
Lafarge Platres brochure entitled "System Pregydeco; couche d'impression integree; plaque de platre et enduit de finition des joints", dated 1988/1989.
Lafarge Platres brochure entitled "Pregydeco; la plaque de plater pre-peinte", dated 1988/1989.
"Assignation devant le Tribunal de Grange Instance de Paris" document dated Apr. 4, 2002.
"Cour d'Appel de Paris" document dated Dec. 18, 2002.

* cited by examiner

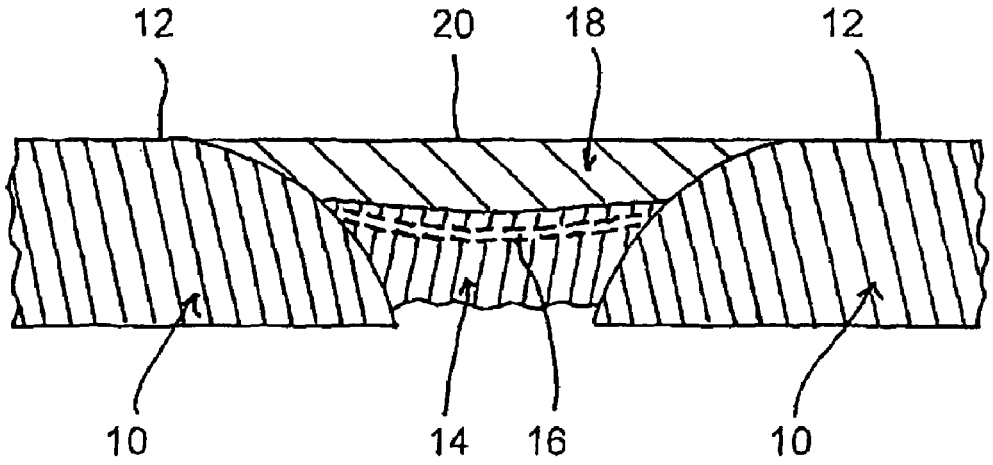
12
20
18
12
10
14
16
10

PLASTERBOARD

FIELD OF THE INVENTION

This invention relates to the manufacture of plasterboard (also known in USA as gypsum wallboard). Plasterboard is well known for use in forming ceilings and interior wall surfaces in buildings. Generally the front face and side edge surface of the plasterboard have been provided by a multi-ply paper referred to as plasterboard liner, while the reverse face is surfaced with a second liner paper. Both of these liners are multi-ply papers.

BACKGROUND OF THE INVENTION

One method for utilising plasterboard has been to fasten the plasterboard into position and then cover its exposed face and the joints between plasterboard sheets with a thin "skim coat" of wet plaster. After this has set, it requires decoration with paint or wallpaper.

Another method for utilising plasterboard has been widely used and dispenses with the "skim coat". The plasterboard is manufactured using a plasterboard liner paper which has a light colour. This is used to form the front surface and the side edge surfaces. The side edges of the boards are shaped to form a recess at their abutting edges. After the boards are fastened into position, their abutting edges are joined with tape and a jointing compound which is worked into the recess on top of the joining tape to create a continuous flat wall surface, with joints visible at regular intervals. The wall is then decorated, either with wallpaper or with multiple coats of paint, which serves among other things to conceal the joints. If paint is used, the normal requirement is a first "mist coat" or primer, followed by two full further coats. This requires painters to come to the wall three times.

There have been a number of proposals for the manufacture of plasterboard with a decorative finish applied during manufacture, prior to fixing the boards in place. Examples of such proposals include U.S. Pat. Nos. 3,507,684, 3,694,298 and 3,984,596.

U.S. Pat. No. 4,579,610 proposed a process in which the surface of a plasterboard liner paper is gravure printed with a clear or tinted latex base coat in a pattern of dots, so that the applied material does not seal the paper. The base paper is then overprinted with a decorative design. This decorative design is not described in detail although it is said that a pattern of blotches is preferred.

Of course, if the surface of the plasterboard is pre-decorated in some way, there can still be a contrast between the boards and a jointing compound which is applied at the joints between boards.

WO 99/57371 discloses lining paper which is given a coating before being made into plasterboard. The coated surface is said to be suitable to receive flexographic printing and there is a suggestion to print a decorative pattern of speckles. The plasterboards may be used as ceiling tiles. Joints between them are not mentioned.

EP-A-521804 (Lafarge) has described plasterboard manufactured using a liner paper with a coating applied to the liner paper before the boards are manufactured. The document recognises that it is desirable to avoid contrast between the colour of the board and the colour of material used to form joints between the boards.

EP-A-1076137 (BPB plc) discloses plasterboard lining paper pre-decorated by printing over its whole surface, with a layer of applied print which appears continuous when inspected by eye. The colour of the print may be matched to the colour of jointing compound. Jointing compounds have been described in a number of documents.

GB-A-1265804 (BPB Industries) discloses a composition containing ground limestone, talc, mica and vinyl copolymer binder. It also teaches addition of small percentages of bentonite clay and cellulose ether.

GB-A-2048235 (BPB Industries) discloses a jointing compound containing gypsum plaster of particle size less than 150 μm, inert mineral filler of particle size 100 μm and polymeric binder which may be polyvinyl alcohol or starch. The mineral filler may be ground limestone, and the exemplified composition includes a small percentage of bentonite.

Both these documents mention that pigment may be included in jointing compounds. GB-A-2048235 mentions that the added colour may serve to match the colour of the facing paper of plasterboard.

Kanuf Bauprodukte GmbH sell moisture resistant grades of plasterboard with a distinctive green surface, and an accompanying jointing compound which is also coloured green to match the board.

WO 97/02395 (Lafarge) discloses a jointing compound intended to match the surface of pre-decorated plasterboard, made using a lining paper with a coated surface, according to EP-A-521804 (Lafarge). This WO 97/02395 teaches that the jointing compound should contain a high proportion of filler which has a particle size of 5 to 35 micrometers. The proprietors of WO 97/02395, Lafarge, sell pre-decorated boards and a jointing compound of matching colour.

Thus it is known to be desirable to match the appearance of the pre-decorated board surface and the jointing compound used with the boards.

We have now observed that when boards are made with pre-decorated lining paper as taught in EP-A-1076137 and joined with a conventional jointing compound, with a good match between the colour of the boards and the jointing compound, there may still be an observable contrast between the surface of the boards and the exposed surface of the jointing compound. It can be described as a visible difference in the texture of the two surfaces.

SUMMARY OF THE INVENTION

Surprisingly, we have found that this problem can be greatly ameliorated by using a printing ink incorporating particulate material of selected particle size. According to a first aspect of this invention there is provided:

pre-decorated plasterboard surfaced with a lining paper which is printed over the whole of one face of the board with an ink containing binder and particulate solid material having a $d_{50}$ mean particle size in a range from 1 to 10 micrometers, with density of print which is sufficient that under optical examination at least 80% of the surface of the lining paper is covered by the applied print and where $d_{50}$ denotes a number length mean particle size such that 50% of particles have volume smaller than a sphere of diameter $d_{50}$ and 50% of particles have volume larger than a sphere of diameter $d_{50}$.

We have found that the use of such a particulate solid with $d_{50}$ greater than 1 micrometer gives a surface texture which is different from the surface texture when the particulate solid in the printing ink is only opacifying pigment of very small particle size. A useful result is a reduction in contrast between the plasterboard and a jointing compound having a colouration matching that of the plasterboard.

It is possible, within the scope of this invention, that this printing ink contains the contrast-reducing particulate solid material as the only particulate material present in the ink. In this event the ink might be somewhat translucent so that it does not hide the colouration of the underlying surface. Such an ink could be used over the top of an underprint containing opaque pigment which did hide the colouration of the underlying paper.

In a preferred arrangement however, printing is carried out using a printing ink which contains this contrast-reducing particulate solid of the particle size specified above and also contains other particulate material which is able to render the ink opaque. Thus in a preferred arrangement, printing is carried out using with an opaque ink containing particulate solids and binder, where the particulate solids include both (i) particulate material having a $d_{50}$ mean particle size in a range from 1 to 10 micrometers, (ii) opacifying pigment having a $d_{50}$ mean particle size not greater than 1.5 micrometers, where, as before the coverage under optical examination is at least 80% of the surface of the lining paper and $d_{50}$ for each particulate material denotes a number length mean particle size for that material such that 50% of its particles have volume smaller than a sphere of diameter $d_{50}$ and 50% of its particles have volume larger than a sphere of diameter $d_{50}$.

BRIEF DESCRIPTION OF THE DRAWINGS

The sole drawing, which will be referred to in Example 5 below, is a cross section at a joint between two adjacent plasterboards.

DETAILED DESCRIPTION OF THE PREFERRED EMBODIMENTS

The opacifying pigment may be a conventional particulate pigment giving opacity to the printing ink and which has very small particle size.

The first-mentioned particulate material, intended to reduce contrast in surface texture, preferably has a $d_{50}$ mean particle size of at least 1.5 or preferably at least 1.8 micrometers. Its $d_{50}$ mean particle size may well be no more than 5 micrometers, preferably no more than 4 or even 3 micrometers. A particularly preferred range of $d_{50}$ mean particle size for this first particulate material is from 1.8 to 3 micrometers. This first particulate material modifies the surface texture of the printed lining paper and hence of the plasterboard made from the lining paper. As a result there is a reduction of the contrast between the plasterboard and jointing compound having a colouration matching that of the plasterboard. Surprisingly this improvement is observed even though the particulate material incorporated in the jointing compound may have a $d_{50}$ mean particle size considerably greater than the $d_{50}$ mean particle size of this particulate material incorporated into the printing ink.

This beneficial effect is observed even when the opaque ink on the lining paper is over-printed with a translucent or transparent second ink usually referred to as a lacquer. As taught in our EP-A-1076137 it is preferred to use this step of applying a translucent or transparent second ink over the first ink. It has the benefit of making the pre-decorated surface more robust and more resistant to marks by tools which come into contact with the surface.

The first-mentioned particulate material incorporated in the printing ink preferably has a particle size distribution such that it has a $d_{90}$ particle size which is not greater than 20 micrometers where $d_{90}$ denotes particle size such that 90% of the particles have volume smaller than a sphere of the diameter $d_{90}$. It is preferred that the first-mentioned particulate material has a $d_{50}$ particle size which is less than 10 micrometers, for example not more than 4 micrometers, together with a $d_{90}$ particle size which does not exceed 10 micrometers. The opacifying pigment in the printing ink preferably has particle size distribution such that it has a $d_{90}$ particle size not greater than 2 micrometers.

Generally, the ratio by weight of the first particulate material to opacifying pigment in the printing ink will lie in a range from 3:1 to 1:3, better 2:1 to 1:1. An opaque printing ink preferably include from 25 to 75%, better 25 to 50% of the first particulate material having $d_{50}$ mean particle size in the range from 1 to 10 micrometers and from 15 to 50%, better 15 to 30% by weight of the opacifying pigment having $d_{50}$ mean particle size not greater than 1.5 micrometers.

Plasterboard in accordance with this invention may be used in a variety of ways, analogous to the diverse utilisations of commercial plasterboard. Thus, sheets in accordance with this invention can be used as ceiling tiles, or used to fabricate walls or ceilings with no joint or a contrasting joint between adjacent sheets. However, the invention is particularly useful when joints between adjacent sheets are finished with a composition intended to provide a continuous surface from one sheet to the next, with the joints becoming indistinguishable from the plasterboard sheets.

In a second aspect this invention provides a combination of materials for wall fabrication comprising sheets of plasterboard as defined above and a jointing compound for surfacing joints at adjacent edges of the plasterboard sheets where the colouration of the printed face of the plasterboard and the colouration of the jointing compound are arranged to match. Both the plasterboard and the jointing compound may be white in colour: indeed white or very pale tints are preferred.

A joint between plasterboard sheets is often formed using more than one layer of mobile jointing compound which sets after application. The layers may be made using different jointing compounds. The jointing compound referred to in the preceding paragraph is used for the final layer so that it forms an exposed surface of the finished joint. It is within the scope of this invention to use the same jointing compound or a different jointing compound to form a first layer at the joint, and subsequently conceal that first layer by application of a jointing compound which, as specified above, is arranged to match the colouration of the surface of the plasterboard.

The numerical measurement of colour may be in terms of the CIELAB system and it is preferred that the colouration of the plasterboard and the colouration of the jointing compound after setting are matched such that their respective values of L, a and b in the CIELAB colour space satisfy the relationship $$\Delta E=[(L_1-L_2)^2+(a_1-a_2)^2+(b_1-b_2)^2]^{1/2}<2$$

where $L_1$, $a_1$ and $b_1$ denote the values of L, a and b of the plasterboard and $L_2$, $a_2$ and $b_2$ denote the values of L, a and b of the jointing compound after the jointing compound has set. More preferably the values of $L_1$ and $L_2$ differ by no more than 1.3 units while the values of $a_1$ and $a_2$ differ by no more than 0.5 or 0.7 units and the values of $b_1$ and $b_2$ also differ from each other by no more than 0.5 or 0.7 units.

If the boards and jointing compound are white in colour, their match in colour may be expressed by a whiteness measurement such as the $WI_{CIE}$ Whiteness Index which is a Colorimetric method to estimate the degree of whiteness, recommended by the Commission International d'Eclairage in 1982.

The parameters L,a,b and $WI_{CIE}$ are related by formulae to values which are measured. An ability to calculate these parameters is normally provided as a function of the measuring instrument.

Preferably $WI_{CIE}$ of the plasterboard and $WI_{CIE}$ of the jointing compound differ by no more than 3.5 units.

Plasterboard sheets may be of conventional size. Thus, boards for use in making walls and ceilings may have length exceeding 2 meters and width exceeding 70 cm, often exceeding 1 meter. Smaller boards may be utilised as ceiling tiles, supported by a grid structure which is itself suspended from above.

In a further aspect this invention provides a method of fabricating an internal wall by fixing a plurality of sheets of plasterboard as defined above edge to edge so as to expose the printed lining paper and applying jointing compound as defined above at joints between adjacent edges of plasterboard sheets such that the jointing compound provides part of the exposed wall surface at the joints.

It is envisaged that jointing compound will also be used to make good any places at which the pre-decorated surface of the plasterboard has been damaged when the plasterboard was fixed in position, for example to cover the heads of any nails driven through the plasterboard.

Materials for use when putting this invention into practice will now be discussed in greater detail.

Printing ink generally consists of solid material of small particle size dispersed in a liquid. Organic polymers to act as binder are also dissolved or dispersed in the liquid.

Although the use of an organic solvent as the liquid portion of the ink is possible, we prefer to use water-based inks.

The organic polymer or polymers which function as binder may be provided by a supplier of printing materials in the form of an aqueous solution of the polymer(s) or as a dispersion of the polymer(s) in an aqueous solution. Such a solution or dispersion may be marketed by its supplier as suitable for use as a clear or translucent lacquer.

Alternatively, such a solution or dispersion may be marketed as suitable for mixing with pigment in order to formulate an opaque printing ink.

Particulate materials which give opacity to a printing ink generally have a refractive index greater than 1.6. Typically they are water-insoluble inorganic solids. Titanium dioxide is the pre-eminent opaque white pigment. It is supplied as a powder of very small particle size, and it may be supplied as concentrated aqueous slurry.

Other materials used as pigments with colours other than white may have larger particle size and may be organic or inorganic compounds.

The use of white particulate materials of refractive index below 1.6 and particle size larger than that of titanium dioxide is already known in other areas of printing technology. However, such materials do not provide much opacity and are merely used as "fillers" or "extenders" to dilute the more expensive titanium dioxide.

Printing inks for use in the present invention may be made by conventional procedures for mixing solid and liquid constituents of inks.

It is normal practice for the manufacture of ink to be carried out by a specialist ink manufacturer who may well be working in close co-operation with a company having facility to manufacture and print paper. The formulation of ink to provide a required colour is part of the normal skill of the ink manufacturer.

Lining Paper

The lining paper onto which the printed colour is applied will normally consist of several layers joined together during the papermaking process. The paper may be made in conventional manner using the normal machinery employed for making multi-ply paper and board by a wet-laid process. The fibres used in the manufacture of the plies of the lining paper may be new or recycled or a mixture of the two.

For the top ply it may be desirable to use fibres which have been bleached or incompletely bleached (so-called semi-bleached fibres) so that the top ply is a light colour before print is applied to it. Alternatively, it may be preferred to use a density of printed colour which is able to mask a darker colour of the liner paper. It may be preferred that the fibres of the top ply are predominantly chemical fibres and therefore lignin-free so as to avoid yellowing. However, if an opaque print is applied, the invention may possibly be put into effect using a top ply formed with a predominance of semi-chemical and/or mechanical fibres which retain some or all of the natural lignin content of the original timber. Use of such fibres relies on the printed layer to stabilise the colouration of the paper, both by reason of its own colour and by shielding the top ply from sunlight thereby preventing or retarding yellowing of the lignin-containing fibres in the top ply. The top ply could be made from pulp—i.e. new fibres. However, for the sake of economy it will normally be made from recycled fibres, supplemented if necessary with new fibres.

Waste paper to provide the recycled fibres will generally be selected to give a light off-white, shade. Suitable sources of mechanical fibres which retain the natural lignin include unprinted newspaper, lightly printed paper and so-called woody trimmings—i.e. off cuts from paper made using mechanical pulp.

Beneath the top ply there may, if desired, be a second ply also having a high proportion of bleached fibres and possibly of similar composition to the top ply. The remaining plies form the interior and the reverse face of the lining paper. It is normal for these to contain a high proportion of unbleached fibres which may be chemical fibres, because their strength is greater than that of mechanical fibres. A suitable source of recycled fibre for these interior plies is recycled corrugated board from boxes and cartons.

Unsorted mixed waste paper B which is the residue after removing higher value light-coloured material B will generally contain a substantial proportion of unbleached chemical fibres from boxes and cartons. It may well be used as the source of recycled fibre for these interior plies.

A plasterboard lining paper conventionally has a weight in a range from 150 to 300 grams per square meter (gsm) and usually lies in a narrower range from 180 to 250 gsm. Paper within this range is suitable for use in this invention.

The porosity of plasterboard lining paper can be determined by the Gurley test of porosity laid down in the British Standard BS 6538: Part 3: 1987 entitled "Air Permeance of Paper and Board". This corresponds to ISO 5635/5—1986 and French standard NFQ03-061.

This test measures porosity as the time for a known volume (100 ml) of air to pass through a sample of predetermined area (6.4 $cm^2$). The result is therefore expressed in seconds/100 ml or simply in seconds because the 100 ml air volume is standard.

Printing Process

Printing onto the paper liner is most easily done before the liner is used in plasterboard manufacture. It is preferably done using a printing process which applies a continuous layer of ink to the substrate which is being printed. A process which is particularly envisaged is flexographic printing. The flexographic process is widely used for printing onto fibreboard for boxes, paper for paper sacks, and other packaging materials. In that application the print is applied to the paper or board from, for example, a "stereo" or a moulded printing roller which is formed using a polymeric material and is a mirror image of the design or wording which is being printed.

Continuous printing along a web (as contrasting with printing a repeating image) is a technique which is already available in the printing industry. For printing over substantially the whole width of a web, a normal flexographic printing machine can be used, but the roller which would normally carry a stereo is instead provided with a continuous surface of the polymer material or a printing roller with a smooth surface can be used.

Where the continuous surface is provided by a flexible sheet of polymeric material wrapped around a roller, edges of the sheet which extend along a circumference of the roller are butted against each other.

Suppliers of sleeves, stereos and moulded rollers for printing include Regal Rubber, Miller Graphics, Design and Stereo Services and Strachan & Henshaw machinery.

Printing could be carried out by another printing process, so long as the result is to apply print to over 80% of the surface to which print is applied. In order to control the colour of the printed liner paper it is desirable that coverage is even higher, such as at least 90% or at least 95% of the area.

Printing by a gravure process at more than one printing station would be a way to cover a high proportion of the total area: gravure dots applied at one printing station could largely fill the gaps between dots applied at another, although overlap of dots would also occur.

Whatever technique is employed it is likely that the weight of solids applied, including binder resin, will lie in a range from 7 to 30 gram/$m^2$.

The lining paper web which receives the print will generally have a width slightly greater than the width of the plasterboards which will be made, so that it can cover one face and two edges of the boards and also wrap around onto the margins of the reverse face where it will be overlapped by the second web.

Preferably the print is applied to the entire width of one surface of a web of lining paper and in consequence the resulting plasterboard has the printed colour completely covering the face of the board, two opposite edges of the board and the margins of the reverse face.

Alternatively, the edge portions of the web which form the edges of the board and wrap around onto the reverse face may be left unprinted. For the sake of good appearance it is preferred that the printed colour extends from the exposed face onto at least part of each edge.

Even with flexographic printing we prefer to print at more than one printing station in order to obtain a combination of properties.

In a preferred arrangement, the first layer of print to be applied is an opaque ink containing both particulate material with d50 in the range 1 to 10 micrometers, as required by this invention and also containing opacifying pigment. Such an ink may well contain more than 40% by weight of particulate solids, as well as binder, water and minor ingredients. The particulate material is likely to constitute more than 50% of the total solids in the ink.

A top layer of print may then contain a much lower proportion of particulate solid or even none at all, e.g. 0 to 25% of the solids content, with a higher proportion of binder resin. Such a layer can serve as a lacquer, giving an improved resistance to marking during handling and to abrasion after wetting. The latter is valuable for giving a "wipe-clean" or washable surface.

Plasterboard Manufacture

As mentioned in EP-A-1076137, it has been found that the application of a continuous printed colour can lead to a large reduction in porosity. The Gurley porosity after printing may lie in a range from 200 to 400 seconds. Surprisingly, however, the manufacture of plasterboard using the printed paper can be carried out by entirely conventional steps. In a typical continuous production process these steps will be:

- unreeling of lining paper onto a production line with the eventual outer face (in the case of the present invention the printed surface) at the underside;
- delivery of wet plaster onto the web of lining paper;
- shaping of the edges of the web to form edges of the eventual plasterboards;
- application of a second web of lining paper to form the reverse face of the boards;
- cutting of the resulting continuous material into individual sheets; and
- passage of these cut sheets through a kiln to dry the plaster.

The steps of introducing wet plaster between two webs of lining paper, shaping edge portions, cutting into lengths and drying the boards will generally all be carried out in conventional manner on automated machinery.

The lining paper web which received the print will generally have a width slightly greater than the width of the plasterboards which will be made, so that it can cover one face and two edges of the boards and also wrap around onto the margins of the reverse face where it will be overlapped by the second web. If the print is applied to the entire width of one surface of a web of lining paper, the resulting plasterboard has the printed colour completely covering the face of the board, two opposite edges of the board and the margins of the reverse face.

Alternatively, the edge portions of the web which form the edges of the board and wrap around onto the reverse face may be left unprinted. For the sake of good appearance it is preferred that the printed colour extends from the exposed face onto at least part of each edge.

Jointing Compounds

Jointing compounds for use in this invention may be made in accordance with existing technology for such compounds.

A suitable composition contains a majority of an insoluble particulate filler. Calcium carbonate may be a convenient choice. Other possibilities are hydrated or anhydrous calcium sulphate and also dolomite.

A suitable size range is a $d_{50}$ value from 10 or 15 micrometers up to 100 or 200 micrometers.

In order to give a smoother surface finish, a small percentage of smaller particle size material may be incorporated. A suitable range of particle size for such material is from 0.1 or 0.5 micrometers up to 10 or 15 micrometers. The percentage which may be included is likely to be small, no greater than 5% of the composition typically in the range up to 2% by weight of the composition. One material which is available with suitable particle size is talc.

Mica particles may be included in a small proportion, typically no more than 5%, possibly no more than 2% by weight of the composition. Mica has small particle size and also has the benefit of reducing shrinkage as a compositions sets.

Bentonite clay may be included in small amount to thicken the overall composition. The amount of clay is likely to be no more than 5%, possibly no more than 2% by weight of the composition.

Another class of materials which may be utilised to increase viscosity of a composition is cellulose ethers. Their amounts are likely to be no greater than 1%, probably no more than 0.7% by weight of the composition, especially if bentonite clay is included.

Suitable binder polymers for incorporation in jointing compositions include polyvinyl alcohol as taught in GB 2048235 A, polyvinyl acetate and mixtures of the two.

Some binder materials react chemically after the composition is applied, and cause it to set. Others rely on evaporation of moisture so that the composition hardens as it dries.

Minor ingredients which may be present in a jointing composition include antifoams, antibacterial compounds, and coloured pigment.

Jointing compositions are made by mixing the constituent solid with water. They may be supplied as powders and mixed with water on site to give a viscous paste or they may be mixed with water by the manufacturer—who can then use mixing machinery in a factory—and sold in sealed containers. A typical water content is in a range from 28 to 35% of the jointing compound, approximately corresponding to water: powder ratios of 0.4 to 0.55.

Test Procedures

There are a variety of methods for particle size determination, and a variety of weightings which can be incorporated when calculating mean values.

For measuring sizes of particulate constituents of printing inks, we have used a Malvern Mastersizer instrument, with a Hydro 2000 sample dispersion accessory to allow observation of particles in liquid suspension. This well-known instrument uses low angle laser light scattering, more commonly known as laser diffraction. This technique determines the volumes of individual particles, from which average particle size can be calculated in several ways, using computer software which accompanies the Malvern Mastersizer instrument.

The size of an individual particle is taken as the diameter of a spherical particle of the same volume, the so-called "equivalent sphere".

The software associated with the Mastersizer instrument enables determination of "number length mean size" denoted as d(0.05) or $d_{50}$. This is a mean value of particle size such that 50% (by number) of the particles have a particle size smaller that this value and 50% (by number) of the particles have particle size larger than this mean value.

Thus, $d_{50}$ is a mean size such that 50% of the particles have a volume larger than the volume of a sphere or diameter $d_{50}$ and 50% of the particles have a volume smaller than the volume of a sphere of diameter $d_{50}$.

Colour Measurement

The CIE (L*a*b*) colour space is a specification of colour perceptions in terms of a three dimensional space. It was one of two systems specified by the Commission Internationale D'Eclairage in 1976. It is also known as the CIELAB formula. The parameter L is the brightness co-ordinate. It is a measure of the brightness of the sample on a grey scale from white=100 to black=0.

a is the red/green co-ordinate with positive values indicating red and negative values indicating green.

b is the yellow/blue co-ordinate with positive values indicating yellow and negative values indicating blue. The difference between two colours can be expressed by the formula $$\Delta E=[\Delta L^2+\Delta a^2+\Delta b^2]^{1/2}$$

where ΔL, Δa and Δb are the differences between the L, a and b values of the two colours.

Colourmetric measurements were made using a Minolta CM 508i instrument to determine values of L, a and b according to the CIELAB system.

The same instrument was used to calculate whiteness as a value of the CIE Whiteness Index ($WI_{CIE}$) as defined by the Commission Internationale d'Eclairage in 1982.

Gloss was determined using a Minolta Multi Gloss 268 instrument at an angle of incident light of 85° to the normal, which is of course a low angle of only 5° to the surface.

Measurement was made parallel to the machine direction of the paper (denoted as MD Gloss) and perpendicular to this direction, i.e. in the cross direction (denoted as C D Gloss). Gloss of jointing compound after setting was measured parallel to the machine direction of the paper, which is along the length of the joint and traverse to the paper and joint.

Porosity—Gurley

The porosity of paper was determined by the Gurley test mentioned above which measures the time (quoted in seconds) for 100 ml of air to pass through a sample area of paper with an areas of 6.4 $cm^2$.

Surface Roughness—Bendtsen

The Bendtsen test for surface roughness can be applied to paper or to plasterboard It is defined by French Standard NF Q 03-049.

Surface Water Absorbency—Cobb

The Cobb test for water absorption is primarily a test which can be applied to paper. It is defined by ISO 535 (also French Standard NF Q 03-014 and British Standard 2644). In this test a 100 $cm^2$ area of surface is defined by means of a ring. Water is placed within the ring under specified conditions for a specified time of 1 minute after which the surplus water is removed and the water-uptake by the test sample is determined as a gain in weight of the sample. The result may be expressed in $g/m^2$. It is possible to apply the Cobb test procedure to plasterboard or to an area of set jointing compound, provided this is sufficiently flat. The results from this test will be affected by the absorptive power of the board or joint material below the surface, and the conditions of storage of samples prior to testing may affect the results obtained.

Water Drop Test

This is another test of water absorption. It requires a smaller area of sample than the Cobb test. In this test one drop of water, having volume 0.05 $cm^3$ is placed on the test surface and the time for complete absorption is measured. The procedure is repeated on different areas of the sample and the results are averaged. Once again, this is a test where the result will be affected by the absorptive power of the board or joint material below the surface. Conditions of storage of samples prior to testing may affect the results obtained. The utilisation of this test and the Cobb test above therefore needs some caution. It will be desirable to apply the test to some form of control at the same time as any test samples.

Wet Abrasion

The wet abrasion test can be applied to paper or plasterboard. It is defined by German Standard (DIN) 53778. It is carried out by using a mechanism to move a brush across the surface under test in a standardised manner, while it is exposed to a humid atmosphere. The number of passes before the surface deteriorates is recorded.

Marking

This test is an observation as to whether the metal tools used to apply the jointing compound make dark marks on the light coloured surface of the pre-decorated plasterboard.

EXAMPLE 1

A number of water-based flexographic printing ink compositions were prepared using the following materials:—

Hydrobase Blanc Z10-070, an aqueous slurry containing 78% by weight titanium dioxide white pigment, supplied by BASF Systemes d'Impression, Clermont, France.

Vernis Q-40-001, an aqueous suspension of organic polymer to act as a binder. The solids content of the suspension, believed to be mostly organic polymer, is about 39% by weight. This composition is also supplied by BASF Systemes d'Impression, Clermont, France.

Calibrite S.L. which is calcium carbonate

Hydrocarb which is calcium carbonate supplied by Omya S.A.S., Paris

Talc de Luzenac 20M2,

DRB3 which is dolomite supplied by AGS BMP

Revetcarb which is a calcium carbonate supplied by BHTL—MEAC

DHBleu which is micronised gypsum supplied by BPB Placo, France.

The $d_{50}$ mean particle sizes of the particulate materials and also their $d_{10}$ and $d_{90}$ values were determined with a Malvern Mastersizer instrument. The meaning of $d_{50}$ and $d_{90}$ has been given above. Analogously, $d_{10}$ is a size (in micrometers) such that only 10% of the particles have volume smaller than a sphere of diameter $d_{10}$.

Flexographic inks were prepared by mixing one or more of the particulate materials with the binder suspension Q-40-001.

In a preliminary experiment, plasterboard lining paper was printed with these inks, but not thereafter overprinted. The samples of paper were examined by light microscopy. They were assessed for five properties which were 1. size of filler aggregate particles deposited in the printing step
2. coverage of paper fibres (expressed as a percentage)
3. filling of the spaces between paper fibres (expressed as a percentage
4. uniformity of the aggregate particles deposited in the printing step
5. opacity of the printed layer, i.e. whether or not it concealed the original colour of the lining paper.

The results are set out in the following table which also gives the ink formulations.

| | | | | INK COMPOSITION | | | EVALUATION WITH BINOCULAR MICROSCOPE (×200) | | | | | |
|---|---|---|---|---|---|---|---|---|---|---|---|---|
| | GRANULOMETRY | | | | | | | | | Uniformity of | | |
| SOLIDS | $d_{10}$ (μm) | $d_{50}$ (μm) | $d_{90}$ (μm) | Solids (wt %) | Q40-001 (wt %) | Added water (wt %)** | Deposited particles | Coverage of Fibres | Filling between fibres | deposited aggregate particles | Size of aggregate particles | Opacity |
| DRB 3 (AGS-BMP) | 1 | 2.8 | 8 | 30 | 70 | 5 | Fine | Medium | Good | Very Good | <10 μm | Translucent |
| Revetcarb (BHTL MEAC) | 1.4 | 7.7 | 45.7 | 30 | 70 | 5 | Medium | Medium | Good | Medium | 10-20 μm | Translucent |
| Calibrite (OMYA) | 2.4 | 19.8 | 41.1 | 30 | 70 | 5 | Medium | Low | Medium | Low | 10-30 μm | Translucent |
| Hydrocarb + Calibrite | 1.1 | 4.4 | 30.5 | 20 + 20 | 60 | 5 | Fine to Medium | Medium | Medium | Medium | 10-30 μm | Translucent |
| Talc (Lusenac) | 3.8 | 10.3 | 22.8 | 30 | 70 | 5 | Medium | Very Good | Good | Low | 10 μm | Translucent |
| DH Bleu (BPB) | 2.6 | 17.9 | 51.7 | 30 | 70 | 5 | Coarse | Medium | Medium | Low | 20-50 μm | Translucent |
| Hydrocarb (OMYA) | 1 | 2.6 | 7.5 | 30 | 70 | 5 | Fine | Good | Good | Very Good | <10 μm | Translucent |
| $TiO_2$ (BASF)* | 0.4 | 0.7 | 1.1 | 88.8% of hydrobase | 10.7 | 5 | Very Fine | Medium | Medium | Good | <<10 μm | Opaque |

*The opaque ink containing titanium dioxide was made by mixing 88.8% of Hydrobase with 10.7% of the polymer suspensions Q40-001. The Hydrobase contained 78% by weight titanium dioxide.

**The amount of water added is given as a percentage of the total (100%) of the weight of particulate solid and polymer suspension Q40-001, or Hydrobase and Q40-001.

As indicated in the upper part of the table, the best uniformity of printed deposit was given by Hydrocarb and DRB23 which had $d_{50}$ values between 2 and 3 micrometers and also had a narrow particle size distribution as indicated by their $d_{90}$ values.

RevertCarb, with larger $d_{50}$ and $d_{90}$ values was not so good. Neither was the 1:1 mix of Hydrocarb and Calibrite. The others, with $d_{50}$ values above 10 micrometers and higher $d_{90}$ values were even poorer, especially as regards uniformity of the deposit on the paper.

None of these printing inks gave effective covering of the top ply of the lining paper. Opaque coverage was only achieved with the ink containing $TiO_2$.

When examined by scanning electron microscope it could be seen that Calibrite, DH Bleu, the Hydrocarb and Calibrite mixture, and (to some extent) Revetcarb allowed the paper fibres to remain visible. These are the materials which have higher $d_{90}$ values.

Titanium dioxide used alone gave a smoother coating than anything else.

Talc appeared to give good coverage of fibres but the printed surface was more uneven than the surfaces provided by Hydrocarb and DRB 3.

EXAMPLE 2

A further ink was made using Hydrocarb and also including Hydrobase to provide $TiO_2$. This had the following formulation:

| | |
|---|---|
| 35.7% | Hydrocarb |
| 28.6% | Hydrobase Z-10-070 |
| 35.7% | Binder suspension Q40-001 |

Water was added in an amount which was 7.1% of the total (100%) of the above.

$d_{50}$ for the mixture of Hydrocarb and titanium dioxide was found to be 4.0 micrometers.

$d_{90}$ for the mixture was 8.2 micrometers.

This ink gave very good results:

| | |
|---|---|
| Deposited particles: | Fine |
| Coverage of fibres: | 50-75% |
| Filling of spaces: | 50-75% |
| Uniformity of deposit: | Uniform |
| Opacity: | Opaque |

When viewed by scanning electron microscope the surface resembled the surface texture provided by the ink which contained Hydrocarb as the only particulate material.

EXAMPLE 3

Flexographic ink was made from a combination of 85% of Hydrobase Z10-070 and 15% of the organic polymer binder suspension Vernis Q-40-001 both as referred to in Example 1. This ink was printed onto lining paper with the amount of ink applied being either 6 or 8 grams per sq meter.

There was no over printing with transparent lacquer. The pre-printed lining paper was used to make plasterboard and sheets of the plasterboard were then joined with a commercial jointing compound between adjacent edges. It was observed that the tools used to carry out the application of jointing compound left dark marks on the surface of the plasterboard.

In a subsequent experiment plasterboard lining paper was printed with an ink consisting of 87% Hydrobase Z10-070 and 13% Vernis Q40-001.

Some of the lining paper was then overprinted with Vernis Q-00-090, an aqueous suspension of organic polymer to act as a binder giving a matte finish, with a solids content of 39%. This is supplied by BASF Systemes d'Impression and sold by them for use as a clear lacquer. The amount applied by printing was 7.5 gms per sq meter so that after drying approximately 3 gms per sq meter of organic polymer had been applied.

The printed lining paper, both with and without the overprint of transparent lacquer was used for making plasterboard. Sheets of the plasterboard were then joined using a commercial jointing compound. It was observed that tools for applying the jointing compound made marks on the sheets which did not have the over-printing with transparent lacquer but did not make marks on the sheets which did have overprinting with transparent lacquer.

EXAMPLE 4

Plasterboard lining paper was printed and then made into plasterboard. The lining paper which was used had the following characteristics before printing:

| | |
|---|---|
| Weight, as measured | 225.4 $gm/m^2$ |
| Resistance to wet abrasion | 11 to 14 cycles |
| Gurley porosity | 190 seconds |
| Cobb, 1 minute, on front face | 17.1 $g/m^2$ |
| Cobb, 1 minute, on reverse face | 20.3 $g/m^2$ |
| L | 90.16 |
| a | 0.458 |
| b | −0.094 |
| $WI_{CIE}$ | 75.16 |
| MD Gloss | 6.5 |
| CD Gloss | 4.9 |
| Bendtsen | 500 ml/min |

It was first printed with an opaque ink, then overprinted with one or other of the following transparent lacquer formulations, both supplied by BASF Systemes d'Impression.

Vernis Q-00-090, as used in Example 3, an aqueous suspension of organic polymer to act as a binder giving a matte finish, solids content 39%. It is sold for use as a clear lacquer.

Vernis Q-816512, an aqueous suspension of organic polymer to act as a binder, giving a matte finish and also containing an anti-slip agent, total solids content 39%. It is sold for use as a clear lacquer.

The ink compositions used are set out in the following table which also gives characteristics of the printed paper. The amount of opaque ink applied was in the range 8 $gm/m^2$ to 12 $gm/m^2$, which in either case was sufficient to provide an opaque print, concealing the colour and texture of the lining paper beneath. The amount of transparent lacquer applied was 7.5 $gm/m^2$.

| | Example no | 4A | 4B | 4C | 4D | 4E | 4F | 4G | 4H |
|---|---|---|---|---|---|---|---|---|---|
| Opaque ink composition | Vernis Q40-001 (wt %) | 14.8 | 13.0 | 10.8 | 46.2 | 46.2 | 35.7 | 35.7 | 35.7 |
| | Hydrobase Z10-070 (wt %) | 84.7 | 86.7 | 88.7 | 7.7 | 7.7 | 28.6 | 28.6 | 28.6 |
| | Hydrocarb (wt %) | 0 | 0 | 0 | 23.1 | 23.1 | 35.7 | 35.7 | 35.7 |
| | Calibrite (wt %) | 0 | 0 | 0 | 23.1 | 23.1 | 0 | 0 | 0 |
| | Added water (% by wt of above) | not measured | not measured | 30 | 8 | 7.1 | 7.1 | 7.1 | 7.1 |
| | Solids deposited from the opaque ink ($g/m^2$) | not determined | not determined | 4.52 | 6.41 | 6.46 | 6.65 | 6.65 | 6.65 |
| Transp. lacquer | Vernis Q00-090 (wt %) | 100 | 100 | 100 | 100 | 100 | 100 | 0 | 0 |
| | Vernis Q816512 (wt %) | 0 | 0 | 0 | 0 | 0 | 0 | 100 | 100 |
| | Solids deposited from the lacquer ($g/m^2$) | 2.93 | 2.93 | 2.93 | 2.93 | 2.93 | 2.93 | | |
| Properties of printed paper | Gurley Porosity (sec) | | 287 | 270 | | | 330 | 327 | 440 |
| | Wet abrasion (cycles) | | | 12-15 | | | 8-13 | 9-13 | 7-11 |
| | Cobb 1 min at 20° C. front face ($g/m^2$) | | 23 | 20 | | | 19.4 | 19.1 | 21 |
| | Cobb 1 min at 20° C. rear face ($g/m^2$) | | 15 | 21 | | | 20.9 | 20.6 | 16 |
| | L | 91.86 | 90.21 | 90.61 | 90.17 | 90.57 | 91.32 | 91.45 | 91.43 |
| | a | −0.75 | 0.68 | −0.64 | −0.82 | −0.05 | −0.11 | −0.17 | −0.10 |
| | b | 2.35 | 6.35 | 3.36 | 4.52 | 1.39 | 1.27 | 1.23 | 1.41 |
| | $WI_{CIE}$ | 61.6 | 37.9 | 61.6 | 54.7 | 70.4 | 72.8 | 73.3 | 72.9 |
| | MD Gloss | 3.4 | 2.9 | 5.1 | 3.9 | 4.2 | 8 | 7.4 | 7.6 |
| | CD Gloss | 2.8 | 2.4 | 4.6 | 3.7 | 3.4 | 6.4 | 5.8 | 5.9 |
| | Bendtsen | 900 | 500 | 1814 | | | 480 | 500 | 350 |

Some of these printed papers were then used to manufacture plasterboard on a conventional plasterboard production line.

Plasterboard sheets made using these pre-decorated lining papers were then fastened in place. Joints between them were made using various commercially available jointing compound intended to match white boards, or else a jointing compound of the following composition (referred to as JC1).

Composition JC1

| Trade Name | Description | % by Weight |
|---|---|---|
| Beatite 16 | Ground limestone | 67.68 |
| Bermocoll E481Q | Cellulose ether | 0.52 |
| Panther A4 | Bentonite clay | 0.75 |
| Mowilith DM 292F (Hoechst) | Vinyl acetate copolymer | 5.52 |
| BYK 035 | Antifoam | 0.13 |
| BX | Fungicide | 0.21 |
| Ultramarine Blue | Pigment | 0.008 |
| | Water | 25.18 |

The $d_{10}$, $d_{50}$ and $d_{90}$ values for samples of Beatite 16 and Panther A4 were determined using the Malvern Mastersizer, and found to be

| | $d_{10}$ | $d_{50}$ | $d_{90}$ |
|---|---|---|---|
| Beatite 16 | 1.98 μm | 23.12 μm | 92.16 μm |
| Panther A4 | 3.58 μm | 20.53 μm | 68.74 μm |

In the above jointing compound formulation the Bermocoll cellulose ether gives water retention and helps to increase the viscosity/stability of the jointing compound prior to use. Mowilith DM 292F from Hoechst is a vinyl acetate copolymer with acts as a binder.

Samples of board and samples of set joints between the boards were tested using some of the tests specified above. The match between boards and jointing compound was also observed visually, both looking directly at the joined boards and looking at an angle of 15 to 20 degrees to the surface. Observations were made by two, sometimes three observers. In each instance, the observers were unanimous in their judgement. Results were as shown in the following table which gives properties of boards, jointing compound after setting, and match between them.

The jointing compounds are denoted by codes. P and L were available as commercial products. Jpb1 and M10 were made for use in these experiments and JC1 is the jointing compound of formulation given above.

| | Paper and plasterboard of Example no | 4A | 4B | 4D | 4E | 4F | 4G | 4H |
|---|---|---|---|---|---|---|---|---|
| Properties of plasterboard | L | 91.76 | 90.21 | 90.22 | 90.56 | 91.28 | 91.48 | 91.33 |
| | a | −0.79 | 0.68 | −0.93 | −0.15 | −0.18 | −0.17 | −0.24 |
| | b | 3.95 | 8.14 | 5.82 | 2.89 | 2.72 | 2.78 | 2.96 |
| | $WI_{CIE}$ | 61.61 | 37.95 | 48.79 | 63.36 | 65.97 | 66.25 | 64.98 |
| | Marking | No | No | No | No | No | No | No |
| | MD Gloss | 3 | 3.7 | 2.2 | 2.2 | 4.2 | 4.8 | 4.2 |
| | CD Gloss | 2.5 | 2.8 | 1.9 | 1.9 | 3.2 | 3.8 | 3.3 |
| | Wet abrasion (cycles) | 7-10 | 4-7 | | 9-15 | 9-13 | 9-16 | 4-6 |
| | Bendtsen | 900 | 2300 | | | 1200 | 1100 | 1200 |
| Properties of jointing compound | Jointing Compound | P | M10 | Jbp1 | L | L | JC1 | JC1 |
| | L | 90.4 | 91.25 | 94.17 | 90.16 | 90.16 | 90.64 | 90.64 |
| | a | 0.3 | 1.08 | 0.78 | 0.25 | 0.25 | −0.38 | −0.38 |
| | b | 3.2 | 7.81 | 5.73 | 2.79 | 2.79 | 2.39 | 2.39 |
| | $WI_{CIE}$ | 61.4 | 42.28 | 59.5 | 62.82 | 62.82 | 65.88 | 65.88 |
| | MD Gloss | 0.8 | 0.7 | 0.7 | 0.8 | 0.8 | 0.4 | 0.4 |
| | CD Gloss | 0.6 | 0.7 | 0.8 | 0.7 | 0.7 | 0.4 | 0.4 |
| Comparison | Δ L (pref. <1.3) | 1.36 | 1.04 | 3.95 | 0.4 | 1.12 | 0.84 | 0.69 |
| | Δ a (pref. <0.5) | −1.09 | 0.4 | 1.71 | 0.4 | 0.43 | 0.21 | 0.14 |
| | Δ b (pref. <0.7) | 0.75 | 0.33 | 0.09 | 0.1 | 0.07 | 0.39 | 0.57 |
| | Δ $WI_{CIE}$ (pref. <3.5) | 0.2 | 4.33 | 10.71 | 0.54 | 3.14 | 0.37 | 0.9 |
| | Δ E (pref. <1.5) | 1.9 | 1.16 | 4.31 | 0.57 | 1.20 | 0.95 | 0.91 |
| | Δ MD Gloss | 2.4 | 3 | 1.5 | 1.4 | 3.4 | 4.4 | 3.8 |
| | Δ CD Gloss | 1.7 | 2.1 | 1.1 | 1.2 | 2.5 | 3.4 | 2.9 |
| Visual assessment, viewing face-on M = Match C = Contrast | | M | C | C | M | M | M | M |
| Visual assessment at 15° angle M = Match C = Contrast | | C | C | C | C | M | M | M |

The values of L, a and b for the plasterboards in the above table are all fairly similar and indicate a pale colour close to white. In most of the examples the colouration of the jointing compound was similar so that the values of ΔE are less than 1.5. Example 4D was the main exception: in this Example the jointing compound had a lighter colour than the plaster boards, indicated by its higher values of L and $WI_{CIE}$. This illustrates an observable mis-match of colour between the boards and the jointing compound used with them.

With the boards of Example 4A where the print applied to the lining paper contained titanium dioxide pigment without Hydrocarb, a better match of colour was achieved and very similar whiteness. When the boards and joint were viewed face on no contrast could be seen between the board and the joint. However, when viewed at an angle of about 15° to the surface a contrast was observed attributable to differences in texture between the surface of the pre-decorated plasterboard and the surface of the jointing compound.

In the case of Example 4E, the ink applied to the lining paper included both Hydrocarb and Calibrite in addition to the titanium dioxide opacifying pigment. A good match of colour and whiteness was achieved as shown by the low LE value of 0.57 and low $\Delta WI_{CIE}$ value of 0.54. When the board was viewed face on it appeared to match the jointing compound. However, once again when the board and jointing compound were viewed at an angle of 15° to the surface, a contrast between them was observable.

In the case of Examples 4F, 4G and 4H, there was an acceptable match of colour and whiteness. No contrast between the boards and the jointing compound was observable when assessed visually by viewing at an angle of 15° to the surface.

These experimental results demonstrate the advantage of boards according to the invention: a good match between the surface of predecorated boards and the surface of joints between them. This will be apparent when boards of the invention are used to make the interior walls of a room: it is inevitable that an observer standing within the room will see parts of its walls at an angle.

Some further properties of boards and jointing compounds were investigated.

Samples of board according to Examples 4G and 4H were joined using jointing compound JC1 and then subjected to a test in which wallpaper was applied to the boards and joint, allowed to dry for 48 hours and then removed. After that, the boards were allowed to dry for 72 hours and then the same cycle of applying wallpaper, leaving it to dry and removing it was repeated. This cycle of applying and removing wallpaper was carried out repeatedly as many times as possible. No paint or primer was applied to the boards before the wallpaper. Removal of the wallpaper was carried out by exposing the wallpaper to steam until soft and then scraping it off the walls with a metal scraper.

It was observed that with these boards embodying the invention, paper could be applied and removed five times. When paper was applied for a sixth time and then removed, the boards showed slight damage and marks from the scraper used to remove the wallpaper.

The same test was applied to commercial boards marketed by Lafarge under their trade mark Pregydeco. The lining paper on these boards had a white coating and was believed to be in accordance with EP 521804.

Wallpaper was applied to these boards, left to dry for 48 hours and then removed. After this cycle of applying and removing wallpaper had been carried out three times, the boards showed damage to such an extent that the boards were not in a suitable condition to be wallpapered again.

The above tests were carried out using a light-weight wallpaper and a standard wallpaper adhesive. The same results were obtained when a heavy-weight wallpaper was used and an appropriate heavier adhesive.

Boards of Example 4G above and a joint made with the above jointing compound JC1 were exposed to sunlight for a period of 120 hours. The CIE parameters L, a and b were measured before and after this test period. The changes in value of L, a and b were too small to be visible to the human eye.

The Cobb test and water drop test procedures were applied to samples of boards according to Example 4H and set joints between them made with the jointing compound JC1 above. As a comparison, the same measurements were made on samples of conventional plasterboards and jointing compound. Each test was carried out four times. Average values are given in the tables below, together with the highest and lowest values recorded in the four tests.

Cobb test results ($g/m^2$)

| | | Plasterboard of Example 4H, with Jointing compound JC1 | Standard commercial plasterboard and jointing compound |
|---|---|---|---|
| Cobb of Board | Average | 18.6 | 15.7 |
| | Lowest | 18.1 | 11.9 |
| | Highest | 19.3 | 18.7 |
| Cobb of Joint | Average | 117.7 | 102.4 |
| | Lowest | 111.8 | 80.3 |
| | Highest | 123.1 | 130.6 |

Water drop test results (minutes)

| | | Plasterboard of Example 4H, with Jointing compound JC1 | Standard commercial plasterboard and jointing compound |
|---|---|---|---|
| Value for Board | Average | 129.8 | 142.9 |
| | Lowest | 128.4 | 141.6 |
| | Highest | 130.5 | 144.1 |
| Value for Joint | Average | 56.7 | 45.8 |
| | Lowest | 54.6 | 45.4 |
| | Highest | 62.0 | 46.1 |

The results in the table above show that the boards of Example 4H and the jointing compound JC1 differ considerably in their surface absorption properties, analogously to conventional plasterboard and jointing compound.

Nevertheless, when samples of plasterboard of Example 4H joined with jointing compound JC1 were painted, it was possible to obtain a specified standard of finish without prior application of a primer coat. In contrast, samples of conventional commercial plasterboard joined with a commercial jointing compound required an initial primer coat in order to reach the same standard of finish.

It was observed that boards of Example 4G slid over one another rather easily and as a result boards piled one upon another would slip when the pile was tilted to an angle of approximately 33° which is considered unsafe. By contrast when the clear lacquer containing an anti-slip agent was used in Example 4H, the slipping of one board against another was reduced and a pile of boards could be tilted to 38 or 39° before they began to slip.

EXAMPLE 5

The sole drawing is a cross section through two adjacent plasterboards according to Example 4H at a joint between them.

Each plasterboard sheet 10 has the predecorated lining paper on its surface 12. The joint between the boards is filled with a first layer 14 of a jointing compound in which a tape 16 is embedded. A second layer 18 of jointing compound provides an exposed surface 20 flush with the surfaces 12.

The jointing compound for layer 18 is compound JC1, which has pale colouration matching that of the surfaces 12. The layer 14 is not exposed to view. Consequently, it may be formed from jointing compound JC1 or alternatively from some other jointing compound which does not match the colouration of surfaces 12.

The invention claimed is:

1. A system of materials for wall fabrication comprising:

(a) plasterboard, and (b) a jointing compound, wherein the plasterboard is surfaced with a lining paper which is printed over the whole of one face of the board with an ink containing binder and particulate solid material having a $d_{50}$ mean particle size in a range from 1 to 10 micrometers, with a density of print such that under optical examination at least 80% of the surface of the lining paper is covered by the applied print, and wherein the jointing compound contains particulate material and binder, the articulate material having a $d_{50}$ mean article size in the range from 15 to 200 micrometers, where $d_{50}$ denotes a number length mean particle size such that 50% of particles have volume smaller than a sphere of diameter $d_{50}$ and 50% of particles have volume larger than a sphere of diameter $d_{50}$.

2. The system according to claim 1 where the lining paper is printed over the whole of one face of the board with an ink containing opacifying pigment having a $d_{50}$ mean particle size not greater than 1.5 micrometers and thereafter over printed over the whole of the same face of the board with said ink.

3. The system according to claim 1 wherein the particulate solids in the ink include both (i) said particulate material having a $d_{50}$ mean particle size in a range from 1 to 10 micrometers, and (ii) opacifying pigment material having a $d_{50}$ mean particle size not greater than 1.5 micrometers, where $d_{50}$ denotes a number length mean particle size such that 50% of particles have volume smaller than a sphere of diameter $d_{50}$ and 50% of particles have volume larger than a sphere of diameter $d_{50}$.

4. The system according to claim 1 wherein the lining paper is also over printed with a less opaque ink over the first said ink.

5. The system according to claim 1 wherein the particulate material has a $d_{50}$ mean particle size in a range from 1.5 to 4 micrometers.

6. The system according to claim 1 wherein the particulate material has a $d_{90}$ particle size not greater than 20 micrometers, where $d_{90}$ denotes a particle size such that 90% of the particles have volume smaller than a sphere of diameter $d_{90}$.

7. The system according to claim 6 wherein the particulate material has a $d_{50}$ mean particle size in a range from 1.5 to 4 micrometers and a $d_{90}$ particle size not exceeding 10 micrometers.

8. The system according to claim 2 wherein the opacifying pigment has a $d_{90}$ particle size not exceeding 2 micrometers.

9. The system according to claim 1 wherein the binder in the ink is one or more organic polymers.

10. The system according to claim 1, wherein the colouration of the plasterboard and the colouration of the jointing compound after setting are matched such that their values of L, a and b in the CIELAB colour space satisfy the relationship $$\Delta E=[(L_1-L_2)^2+(a_1-a_2)^2+(b_1-b_2)^2]^{1/2}<2$$

where $L_1$, $a_1$ and $b_1$ denote the values of L, a and b of the plasterboard and $L_2$, $a_2$ and $b_2$ denote the values of L, a and b of the jointing compound after setting thereof.

11. The system according to claim 10 where $$L_1=L_2\pm1.5$$

$$a_1=a_2\pm0.7$$

$$b_1=b_2\pm0.7.$$

12. A method of fabricating an internal wall by fixing a plurality of sheets of plasterboard as defined in claim 1 edge to edge so as to expose faces surfaced with said lining paper, applying jointing compound as defined in claim 1 at joints between adjacent edges of plasterboard sheets so as to provide part of the exposed wall surface at these joints.

13. The system according to claim 3 wherein the opacifying pigment has a $d_{90}$ particle size not exceeding 2 micrometers.

* * * * *

UNITED STATES PATENT AND TRADEMARK OFFICE

CERTIFICATE OF CORRECTION

PATENT NO. : 7,591,113 B2
APPLICATION NO. : 10/499835
DATED : September 22, 2009
INVENTOR(S) : Mourier It is certified that error appears in the above-identified patent and that said Letters Patent is hereby corrected as shown below:

On the cover page,

Item [*] Notice: Subject to any disclaimer, the term of this patent is extended or adjusted under 35 U.S.C. 154(b) by 721 days.

Delete the phrase "by 721 days" and insert -- by 1096 days --

Signed and Sealed this

First Day of June, 2010

David J. Kappos

David J. Kappos
*Director of the United States Patent and Trademark Office*